US006076037A

United States Patent [19]

Ono et al.

[11] Patent Number: 6,076,037

[45] Date of Patent: Jun. 13, 2000

[54] ENGINE CONTROL SYSTEM

[75] Inventors: Masato Ono; Nobuaki Suzuki, both of Shioya-gun, Japan

[73] Assignee: Keihin Corporation, Tokyo, Japan

[21] Appl. No.: 09/108,212

[22] Filed: Jul. 1, 1998

[30] Foreign Application Priority Data

Oct. 27, 1997 [JP] Japan ..... 9-293997

[51] Int. Cl.[7] ..... F02D 41/26

[52] U.S. Cl. ..... 701/115; 123/674

[58] Field of Search ..... 123/674, 406.33, 123/406.19, 480, 339.19, 675; 701/102–105, 114, 115

[56] References Cited

U.S. PATENT DOCUMENTS

| | | | |
|---|---|---|---|
| 4,571,683 | 2/1986 | Kobayashi et al. | 701/106 |
| 4,715,344 | 12/1987 | Tomisawa | 123/339.12 |
| 4,762,105 | 8/1988 | Beyer et al. | 123/406.19 |
| 4,924,836 | 5/1990 | Uchida et al. | 123/674 |
| 5,024,199 | 6/1991 | Abe | 123/674 |
| 5,247,446 | 9/1993 | Motz et al. | 701/115 |
| 5,638,800 | 6/1997 | Furuya et al. | 123/674 |
| 5,687,699 | 11/1997 | Shimada et al. | 123/673 |

*Primary Examiner*—Henry C. Yuen
*Assistant Examiner*—Arnold Castro
*Attorney, Agent, or Firm*—Arent, Fox, Kintner, Plotkin & Kahn

[57] ABSTRACT

An engine control system in which a plurality of engine control data values corresponding to respective values of a predetermined engine operating parameter are previously stored in a read only memory, correction data indicative of a correction value for correcting errors of the engine control data values stored in the read only memory is stored in a rewritable memory, and one of the engine control data values corresponding to a detected value of the predetermined engine operating parameter is read out from the read only memory, while the correction data stored in the rewritable memory is read out to obtain the correction value, whereby the read engine control data value is corrected by using the correction value in order to control the engine based on the corrected engine control data value.

6 Claims, 3 Drawing Sheets

FIG. 2

| STORED VALUE | $K_{TI}$ |
|---|---|
| FF<br>⋮ | ⋮ |
| 80 | 1.1 |
| 81 | 1.2 |
| 7E | 1.0 |
| 7F | 0.9 |
| ⋮<br>00 | ⋮ |

ENGINE CONTROL SYSTEM

BACKGROUND OF THE INVENTION

1. Field of the Invention

The present invention relates to an engine control system for calculating an engine control amount, such as an amount of fuel to be supplied to the engine.

2. Description of the Related Background Art

Control of an internal combustion engine, such as fuel injection control for controlling the amount of fuel to be supplied to the engine by injection via a fuel injector, and secondary air control for controlling the amount of secondary air so as to supply secondary air into an intake pipe at a location downstream of a throttle valve via a secondary air passage bypassing the throttle valve, is carried out by a CPU (central processing unit) in accordance with programs therefor. The programs are previously written in a ROM (read only memory) together with engine control data including various kinds of data tables, and the CPU reads out the programs and data store in the ROM to calculate such engine control amounts.

For instance, in the case of fuel injection control, engine control data, such as a data table of a basic fuel injection amount which is determined in accordance with intake pipe inner pressure of the engine and engine rotational speed and a data table of an engine cooling temperature-dependent correction coefficient which is determined in accordance with an engine cooling temperature, is stored in the ROM. During execution of the fuel injection control, engine operating parameters, such as the intake pipe pressure of the engine, the engine rotational speed, the engine cooling temperature, and the concentration of oxygen present in exhaust gases, are detected by various kinds of sensors. A value of the basic fuel injection amount corresponding to the detected values of the intake pipe pressure of the engine and the engine rotational speed is extracted from its data table, and a value of the engine cooling temperature-dependent correction coefficient is extracted from its data table. The basic fuel injection amount is corrected by the engine cooling temperature-dependent correction coefficient, correction coefficients corresponding to the oxygen concentration in exhaust gases and so forth to thereby calculate the fuel injection amount.

If internal combustion engines of the same type are mass-produced, molds for manufacturing the engines are aged, causing delicate changes in engines which are mass-produced from such aged molds. This makes it impossible to suitably control these engines by using engine control amounts based on the engine control data which is stored in the ROM and obtained from the engines initially produced from the molds. In this case, it is normally required to write appropriate engine control data in a new ROM, so that the ROMs provided for mass-produced engines become useless.

To constantly obtain appropriate engine control amounts without using a ROM storing new engine control data, a voltage divider, which consists of two resistances connected in series, is used in a conventional engine control system. That is, the conventional engine control system is configured such that correction voltage generated by the voltage divider is supplied via an A/D converter to the CPU as the digitized correction voltage value. The ROM previously stores data indicative of the relationship between values of the correction voltage and data correction coefficients as a data table, and the CPU obtains a data correction coefficient corresponding to the supplied correction voltage value from the data table and corrects the engine control data by using the data correction coefficient to calculate an engine control amount, such as a fuel injection amount. The resistance values of the voltage divider are set in consideration of a value of the data correction coefficient decided to obtain optimum engine control by testing mass-produced engines.

When the data stored in the ROM is corrected by using the voltage divider, however, a resolution of the correction voltage to be obtained as the digitized value by a ratio between the two resistance values of the voltage divider is low as 25 digital values. Therefore, when a range for the correction is tried to expand, the engine control data is not optimally corrected since data correction coefficient obtained in the CPU becomes a coarse value.

SUMMARY OF THE INVENTION

It is the object of the invention to provide an engine control system which is capable of correcting engine control data stored in a ROM with high accuracy to calculate an optimum engine control amount.

According to the invention, there is provided an engine control system comprising detecting means for detecting a predetermined engine operating parameter; a read only memory in which a plurality of engine control data values corresponding to respective values of the predetermined engine operating parameter are previously stored; a rewritable memory storing correction data indicative of a correction value for correcting errors of the engine control data values stored in the read only memory; reading means for reading out one of the engine control data values corresponding to a value of the predetermined engine operating parameter detected by the detecting means, from the read only memory; correction value-obtaining means for reading out the correction data stored in the rewritable memory to obtain the correction value; and control means for correcting the engine control data value read out by the reading means by using the correction value obtained by the correction value-obtaining means, and controlling the engine based on the corrected engine control data value.

BRIEF DESCRIPTION OF THE DRAWINGS

FIG. 2 is a diagram showing the relationship between stored values and data correction coefficients $K_{TI}$.

DETAILED DESCRIPTION OF THE PREFERRED EMBODIMENT

The invention will now be described in detail with reference to the drawings showing an embodiment thereof.

Figure 1:
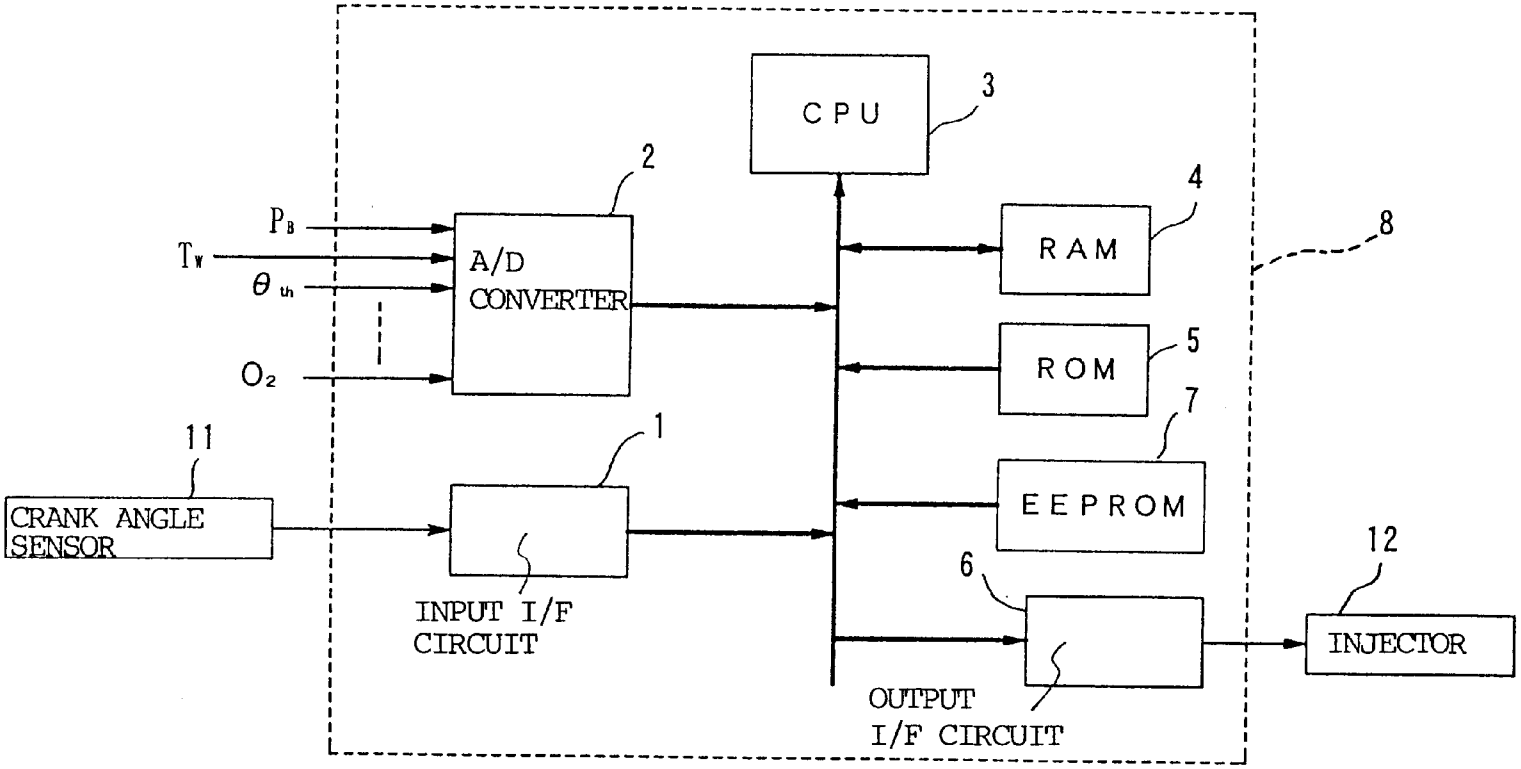
FIG. 1 is a block diagram showing an embodiment of the present invention.

FIG. 1 shows an engine control system according to the present invention. The engine control system includes an input interface (I/F) circuit 1, an analog/digital (A/D) converter 2, a CPU 3, a RAM 4, a ROM 5 and an output interface circuit 6, all of which are connected to each other via a bus. The portion of the above devices connected in common via the bus is formed as an ECU (Electronic Control Unit) 8. Connected to the input interface circuit 1 is a crank angle sensor 11 which generates a rotation pulse each time a crankshaft of an internal combustion engine, not shown, rotates by a predetermined angle (e.g. 30 degrees) and a reference pulse indicative of a time point at which the crankshaft of the engine reaches a reference position. The input interface circuit 1 shapes the waveforms of rotation pulses and reference pulses generated from the crank angle sensor 11 to supply the shaped pulses to the CPU 3. The CPU 3 obtains an engine rotational speed Ne based on a repetition period of the rotation pulses, and detects a time point when the crankshaft reaches the reference position based on the reference pulses to determine control timings for the engine such as a fuel injection timing and an ignition timing.

The A/D converter 2 converts analog signals from a plurality of sensors for detecting engine operating parameters such as intake pipe inner pressure $P_B$ at a location downstream of a throttle valve, engine cooling temperature Tw, throttle valve opening degree θth, and oxygen concentration $O_2$ in exhaust gases, which are required for control of the engine.

The CPU 3 carries out arithmetic operations such as a fuel injection amount-calculating operation in accordance with programs stored in the ROM 5. During the arithmetic operations, the CPU 3 temporarily writes data into the RAM 4, and reads the stored data therefrom. The ROM 5 is a mask ROM that is previously stored with programs for carrying out the engine control such as the fuel injection control, and various kinds of data tables (e.g. a Ti data table, an A/F data table, a Tw data table, and a WOT data table, referred to hereinafter).

The output interface circuit 6 drives an injector 12 in response to a injector-driving command received from the CPU 3. The injector 12 is located near an intake port of an intake pipe of the internal combustion engine to inject fuel when it is driven.

The engine control system further includes an EEPROM (electrically erasable and programmable ROM) 7 connected to the bus. The EEPROM 7 is capable of writing and erasing data, and is equipped with a circuit, not shown, therefor. A data correction coefficient for correcting data of a data map or the like stored in the ROM 5 is written in the EEPROM 7 at the product-testing stage of mass-produced engines, e.g. lot by lot. The data correction coefficient has one byte for example, and when one character is formed by four bits, 256 types of data correction coefficient are obtained. In the embodiment, it is assumed that a data correction coefficient $K_{TI}$ of a basic fuel injection period Ti is written in the EEPROM 7. It should be noted that, as shown in FIG. 2, one of 00 to FF in hexadecimal may be stored in the EEPROM 7 as its stored value to define a corresponding value as a data correction coefficient $K_{TI}$.

Figure 3:
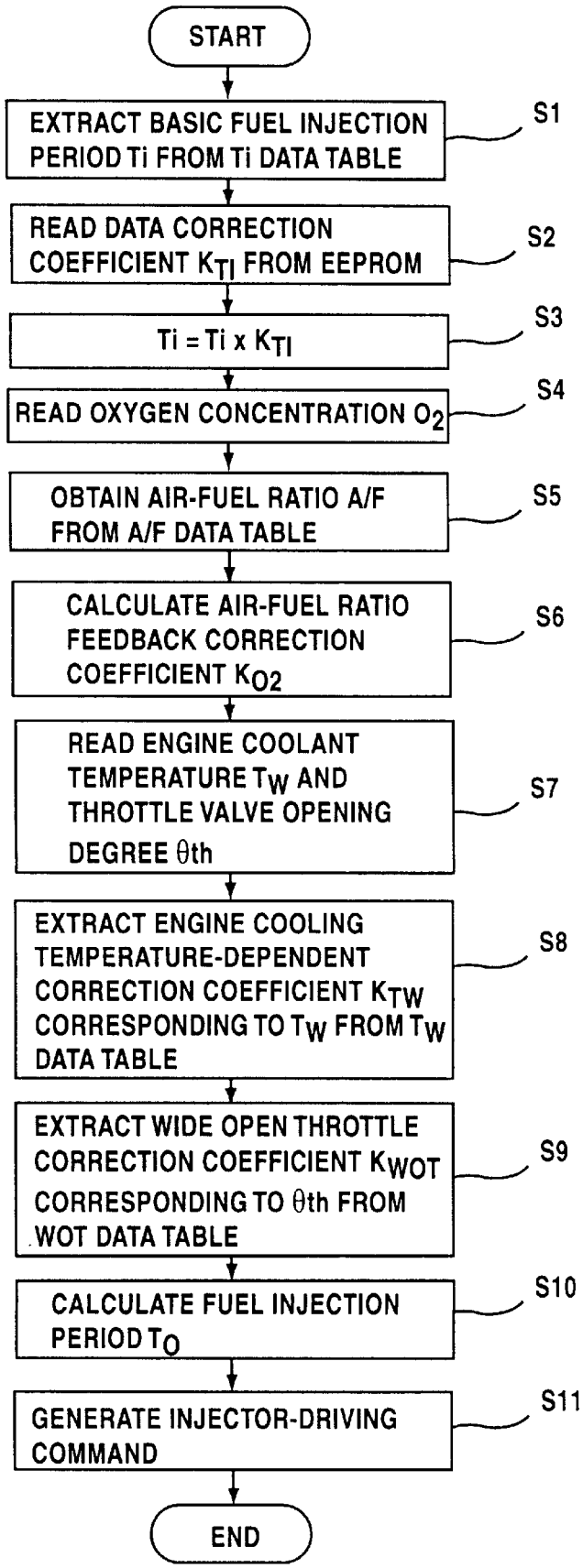
FIG. 3 is a flowchart showing a routine for carrying out fuel injection control.

Next, fuel injection control will be described as an example of the engine control carried out by the engine control system constructed as above. Referring to FIG. 3, first, the CPU 3 extracts a basic fuel injection period Ti from the Ti data table stored in the ROM 5, in accordance with a detected value of the engine rotational speed Ne and that of the intake pipe inner pressure $P_B$ in step S1 and then reads out a data correction coefficient $K_{TI}$ from the EEPROM 7 in step S2. The extracted basic fuel injection period Ti is multiplied by the data correction coefficient $K_{TI}$ and the product of the multiplication is set to a new basic fuel injection period Ti in step S3.

Next, the CPU 3 reads out a detected oxygen concentration $O_2$ in step S4 to obtain a present air-fuel ratio A/F corresponding to the oxygen concentration $O_2$ from the A/F data table in step S5, and then calculates a feedback correction coefficient $K_{02}$ in dependence on whether the present air-fuel ratio A/F is larger or smaller than a desired air-fuel ratio (e.g. 14.7) in step S6. In calculating the feedback correction coefficient $K_{02}$, for example, when the present air-fuel ratio A/F is larger than the desired air-fuel ratio, which means that the present air-fuel ratio A/F of a mixture supplied to the engine is lean, a predetermined value α ($0<\alpha<1$) is subtracted from the feedback correction coefficient $K_{02}$ to set the resultant value to the present feedback correction coefficient $K_{02}$, whereas when the present air-fuel ratio A/F is smaller than the desired air-fuel ratio, which means that the present air-fuel ratio A/F is rich, the predetermined value α is added to the feedback correction coefficient $K_{02}$ to set the resultant value to the present feedback correction coefficient $K_{02}$.

Further, the CPU 3 reads detected values of the engine cooling temperature Tw and the throttle valve opening degree θth in step S7 to extract an engine cooling temperature-dependent correction coefficient $K_{TW}$ corresponding to the detected engine cooling temperature Tw from the Tw data table in step S8 and extract a wide open throttle correction coefficient $K_{WOT}$ corresponding to the detected throttle valve opening degree θth from the WOT data table in step S9. After determining the correction coefficients as described above, the CPU 3 multiplies the basic fuel injection period Ti by the feedback correction coefficient $K_{02}$, the engine cooling temperature-dependent correction coefficient $K_{TW}$ and the wide open throttle correction coefficient $K_{WOT}$ to obtain a fuel injection period $T_0$ in step S10, and then delivers the injector-driving command for driving the injector 12 by the fuel injection period $T_0$ to the output interface circuit 6 in step S11. In response to the command, the output interface circuit 6 drives the injector 12 at suitable timing by the fuel injection period $T_0$. Thus, the fuel is supplied to the engine by injection.

Although in the embodiment described above, the fuel injection control is described as the example of the engine control, this is not limitative, and it is possible to apply the invention to any other type of the engine control which uses a data table stored in the ROM, such as secondary air control, idling rotational speed control and ignition timing control.

Further, although the above EEPROM 7 may be soldered to the circuit board of the ECU 8 together with the CPU 3 and other components, it may be removably plugged into a socket as well. Furthermore, the EEPROM 7 may store a plurality of data correction coefficients, while a readout address may be set to thereby select one of the data correction coefficients.

Further, the ROM 5 may store a plurality of data correction coefficients, while the EEPROM 7 store address-designating data for designating a readout address that designates one of the data correction coefficients stored in the ROM 5. The CPU 3 reads out the data correction coefficient stored at the address corresponding to the address-designating data obtained from the EEPROM 7.

Further, although in the above embodiment, the EEPROM is used, this is not limitative, and other kinds of nonvolatile rewritable memory may be used.

As described above, according to the invention, a plurality of engine control data values corresponding to respective values of a predetermined engine operating parameter are previously stored in a read only memory, correction data indicative of a correction value for correcting errors of the engine control data values stored in the read only memory is stored in a rewritable memory, and one of the engine control data values corresponding to a detected value of the predetermined engine operating parameter is read out from the read only memory, while the correction data stored in the rewritable memory is read out to obtain the correction value, whereby the read engine control data value is corrected by using the correction value in order to control the engine based on the corrected engine control data value. This makes it possible to correct the engine control data stored in the read only memory with high accuracy to thereby calculate an optimum engine control amount. Further, the rewritable memory can store digital values of correction data, and hence it is not required to provide a special A/D converter as used in the conventional control systems for converting the correction data to a digital value. Further, the range of correction can be made larger than that realized by the conventionally-employed voltage divider. This makes it possible to further reduce the necessity of remaking a ROM such that it stores updated engine control data.

What is claimed is:

1. An engine control system comprising:

detecting means for detecting predetermined engine operating parameters indicative of operating conditions of an engine;

a read only memory in which a plurality of engine control data values corresponding to respective values of said predetermined engine operating parameters are previously stored;

a rewritable memory in which correction data indicative of a correction value peculiar to said engine is stored at the production stage of said engine in order to correct errors of said engine control data values stored in said read only memory;

reading means for reading out one of said engine control data values corresponding to a value of said predetermined engine operating parameter detected by said detecting means, from said read only memory;

correction value-obtaining means for reading out said correction data stored in said rewritable memory to obtain said correction value; and control means for correcting the engine control data value read out by said reading means by using said correction value obtained by said correction value-obtaining means, and for controlling said engine based on the corrected engine control data value.

2. The engine control system according to claim 1, wherein said correction data stored in said rewritable memory directly indicates said correction value.

3. The engine control system according to claim 1, wherein said read only memory stores a plurality of correction values different from each other, said rewritable memory stores data designating one of said plurality of correction values different from each other, as said correction data, and said correction value-obtaining means reads out said one of said correction values designated by said correction data stored in said rewritable memory, from said read only memory.

4. The engine control system according to claim 1, wherein said read only memory is a mask ROM, and wherein said rewritable memory is an EEPROM.

5. The engine control system according to claim 1, wherein said correction data represents a change in the engine due to a manufacturing process of the engine.

6. The engine control system according to claim 1, wherein said correction data corresponding to a change in said engine during manufacture due to aging of an engine mold.

* * * * *